US005117669A

United States Patent [19]

Lisec

[11] Patent Number: 5,117,669

[45] Date of Patent: Jun. 2, 1992

[54] APPARATUS FOR BENDING HOLLOW PROFILE STRIPS

[76] Inventor: Peter Lisec, Bahnhofstrasse 34, A-3363 Amstetten-Hausmening, Austria

[21] Appl. No.: 701,124

[22] Filed: May 16, 1991

[30] Foreign Application Priority Data

May 21, 1990 [AT] Austria ..... 1126/90
Sep. 10, 1990 [AT] Austria ..... 1840/90

[51] Int. Cl.[5] ..... B21D 11/00

[52] U.S. Cl. ..... 72/319; 72/304; 72/320; 72/386

[58] Field of Search ..... 72/314, 320, 304, 323, 72/322, 306, 386, 387, 388, 391.2

[56] References Cited

U.S. PATENT DOCUMENTS

| | | | |
|---|---|---|---|
| 2,343,441 | 3/1944 | Babcock et al. | 72/319 |
| 3,983,735 | 10/1976 | Berry | 72/319 |
| 3,994,152 | 11/1976 | Wolters | 72/319 |
| 4,597,279 | 7/1986 | Lisec | 72/306 |
| 4,836,005 | 6/1989 | Lisec | 72/306 |

FOREIGN PATENT DOCUMENTS

| | | | |
|---|---|---|---|
| 0121873 | 10/1984 | European Pat. Off. . | |
| 0318748 | 6/1989 | European Pat. Off. . | |
| 2825518 | 7/1979 | Fed. Rep. of Germany | 72/319 |
| 2923769 | 1/1980 | Fed. Rep. of Germany . | |
| 3221986 | 12/1983 | Fed. Rep. of Germany . | |
| 3312764 | 10/1984 | Fed. Rep. of Germany . | |
| 3223881 | 9/1985 | Fed. Rep. of Germany . | |
| 8705796 | 7/1987 | Fed. Rep. of Germany . | |
| 2449222 | 9/1980 | France . | |
| 0023786 | 6/1977 | Japan | 72/319 |
| 0046785 | 12/1978 | Japan | 72/319 |
| 0194075 | 1/1965 | Switzerland | 72/388 |
| 2114201 | 8/1983 | United Kingdom . | |

*Primary Examiner*—Lowell A. Larson
*Assistant Examiner*—Michael J. McKeon
*Attorney, Agent, or Firm*—Young & Thompson

[57] ABSTRACT

An apparatus for bending hollow profile strips (1) into spacer frames for insulating glass planes includes a clamp for the hollow profile strip, which clamp can be brought into contact with the lateral surfaces of the hollow profile strip (1), an abutment (20), about which the hollow profile strip (1) is bent, and a pivotable bending lever (50). The abutment (20) is exchangeably attached to a support (21) and can be moved into and out of its operative position by pivoting the support (21) about an axis perpendicular to the plane of symmetry of the clamp (2) and by shifting the support (21) perpendicularly to the plane of symmetry of the clamp (2).

16 Claims, 4 Drawing Sheets

APPARATUS FOR BENDING HOLLOW PROFILE STRIPS

The invention relates to an apparatus for bending hollow profile strips, particularly for bending hollow profile strips into spacers for insulating glass panes, with two jaws which can be brought into contact with the lateral surfaces of the hollow profile strip to be bent, an abutment around which the hollow profile strip is bent at an angle, and a bending lever pivotable with respect to the abutment for performing the bending operation.

Such bending devices which, in part, are to yield maximally sharp-edged bends of the hollow profile strips are known in various designs. Attention is invited, for example, to German Patent 3,223,881, German Utility Model 8,705,796, or U.S. Pat. No. 4,836,005.

Moreover, spacer frames produced in one piece with bent corners, as well as devices for producing these spacer frames, have been known from French Patent 2,449,222 and DOS 3,221,986. Finally, DOS 3,312,764 also should be noted, from which it is known to bend hollow profile strips into spacers for insulating glass panes wherein a mandrel is provided in the region of the bending site which can be brought into contact with the hollow profile strip from the inside. Bending takes place by the pivoting of a jaw, the other end of the profile strip being clamped in place between a movable clamping jaw and an abutment in contact from the inside of the profile strip.

One problem arising in the known bending devices is that the sharp-edged bends required for use in connection with insulating glass panes cannot always be obtained without difficulties. This is so because, in part, there is the danger that the walls of the hollow profile strip will develop tears during the bending step, and the lateral surfaces of the hollow profile strips do not always extend in planar fashion in the corner zone, i.e. at the location where they have been bent, but rather exhibit undulations which interfere with and impede the subsequent processing of the spacer frame, especially the coating of the lateral surfaces of the spacer frames with sealing compound or adhesive.

EP-A-318,748 describes an apparatus for bending hollow profile strips into spacer frames wherein the abutment is movably mounted and is to execute a pivoting and/or shifting motion during the bending operation. In this arrangement, the pivoting motion of the abutment follows the movement of the bending lever which engages from the outside at the hollow profile to be bent. This is to achieve the result that the inner wall of the hollow profile will move inwardly during the bending motion and will finally come into contact with the outer wall, likewise deformed toward the inside by the pressure roller For this purpose, a control cam can be provided in accordance with FIG. 6 of EP-A-318,748 which additionally moves the abutment, during its pivotal motion, in the direction of its longitudinal extension.

The apparatus disclosed in DOS 2,923,769 for the bending of hollow profile strips includes a tool that can be advanced during the bending step; this tool is to shape the web of a longitudinal section of a spacer strip at the highest point of the bend during the bending operation. It is expressly pointed out in DOS 2,923,769 that the "counter bearing tool" during the bending process is to be pushed, with the aid of a wedge, into the highest location of the bend. In the apparatus according to DOS 2,923,769, the bending tool is to constitute simultaneously the lateral guidance for the lateral flanks of the U-shaped spacer strip; in this arrangement, the distance of the guide surface for these lateral flanks at the counter bearing tool cannot be varied since this tool is made of one piece.

Moreover, although it is possible in the known bending devices to produce obtuse angles between the legs adjoining the corner, acute angles can be achieved only with difficulties.

The invention is based on the object of making available an improved bending apparatus (bending head) making it possible to bend hollow profile strips with extensively arbitrary, preselectable angles formed by the legs adjoining the corner with each other.

This object has been attained according to this invention, in an apparatus of the type discussed hereinabove, by providing that the abutment is retained on a support which is adjustable in the plane of symmetry of the clamp, as well as in parallel to the plane of symmetry of the clamp, and also perpendicularly to this plane of symmetry, for moving the abutment away out of the bending plane.

Advantages, features, and details of the invention can be seen from the following description of embodiments, reference being had to the accompanying drawings wherein.

Figure 1:
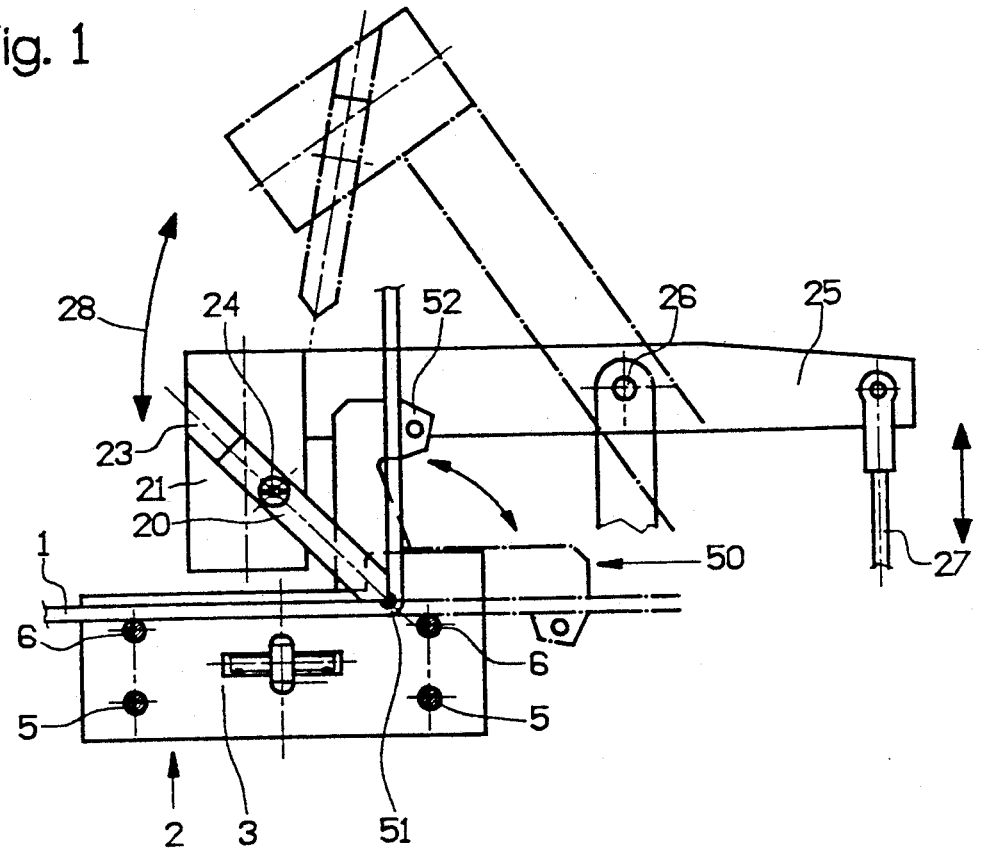
FIG. 1 shows a bending head in a lateral view.

The apparatus according to this invention for bending hollow profile strips 1 consists of a clamp 2 with a locally fixed clamping jaw 3 and a clamping jaw 4 which latter is movable with respect to the first-mentioned jaw (FIG. 1 does not show the clamping jaw 4). The movable clamping jaw 4 can be displaced by way of guide pins 5 and 6, each of which are arranged in pairs, in the direction of double arrow 7 (FIG. 2), so that the opening width of the clamp 2 can be adapted to the breadth of the hollow profile strip 1 to be bent.

Figure 2:
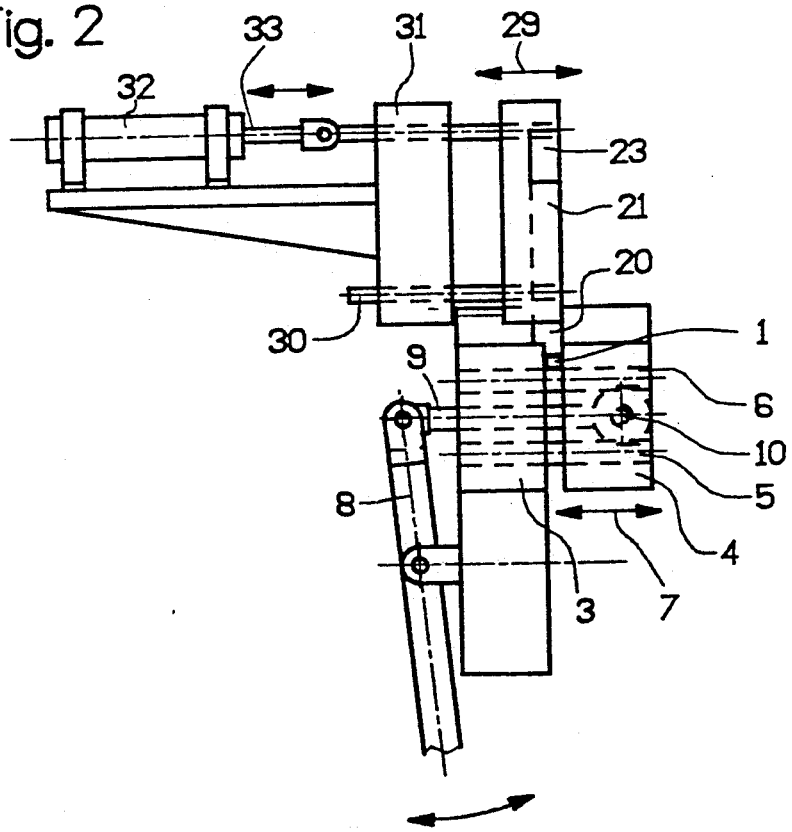
FIG. 2 shows a bending head, seen from the left-hand side of FIG. 1.
Figure 3:
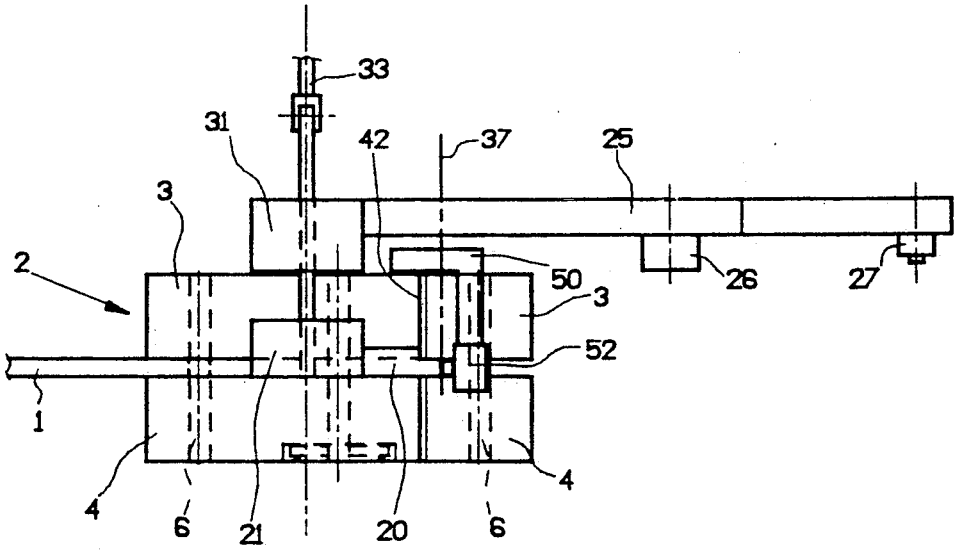
FIG. 3 shows a top view of the bending head.

A lever 8, pivotably supported at the fixed clamping jaw 3, is provided for operating the movable clamping jaw 4 in the direction of arrow 7 (FIG. 2). The lever 8 is coupled with the movable clamping jaw 4 via a tie rod 9 which latter is supported by way of a bearing 10 in a pivotably movable fashion at the clamping jaw 4. The pivot lever 8 is operated by means of a linear motor, not shown, for example a dual-acting pressure medium cylinder.

The bending apparatus furthermore includes an abutment 20 exchangeably inserted in a support 21. For this purpose, a groove 23 is recessed in the support 21; the abutment 20 can be inserted in this groove with a sliding fit and is retained at that location by a screw 24, for example.

The support 21 for the abutment 20 is mounted to a lever 25 which latter is pivotable about a bearing 26 affixed to the machine frame, i.e. a bearing immovable with respect to the fixed clamping jaw 3 of the clamp 2, in the direction of double arrow 28 from the operative position illustrated in solid lines in FIG. 1 into the ready position shown in dot-dash lines in FIG. 1, with the aid of a linear motor 27, for example a dual-acting pressure medium cylinder.

In addition, the support 21 for the abutment 20 is adjustable perpendicularly to the plane of symmetry of the clamp 2, as shown in FIG. 2, namely in the direction of double arrow 29 illustrated in FIG. 2. For this purpose, the support 21 is displaceably guided via guide means 30 in a holder 31 connected with the lever 25. A linear motor, in the illustrated embodiment a dual-acting pressure medium cylinder 32, is provided for adjusting the support 21 and thus the abutment 20 in the direction of double arrow 29; the piston rod 33 of this motor is coupled with the support 21 by way of a tie rod.

In this way, the abutment 20 can not only be swung in a plane in parallel to the plane of symmetry of the clamping jaw 2 (double arrow 28), but can also be adjusted in a direction perpendicular to the plane of symmetry of the clamp 2 (double arrow 29) so that the abutment 20 can be moved in its entirety out of the bending zone.

Figure 4:
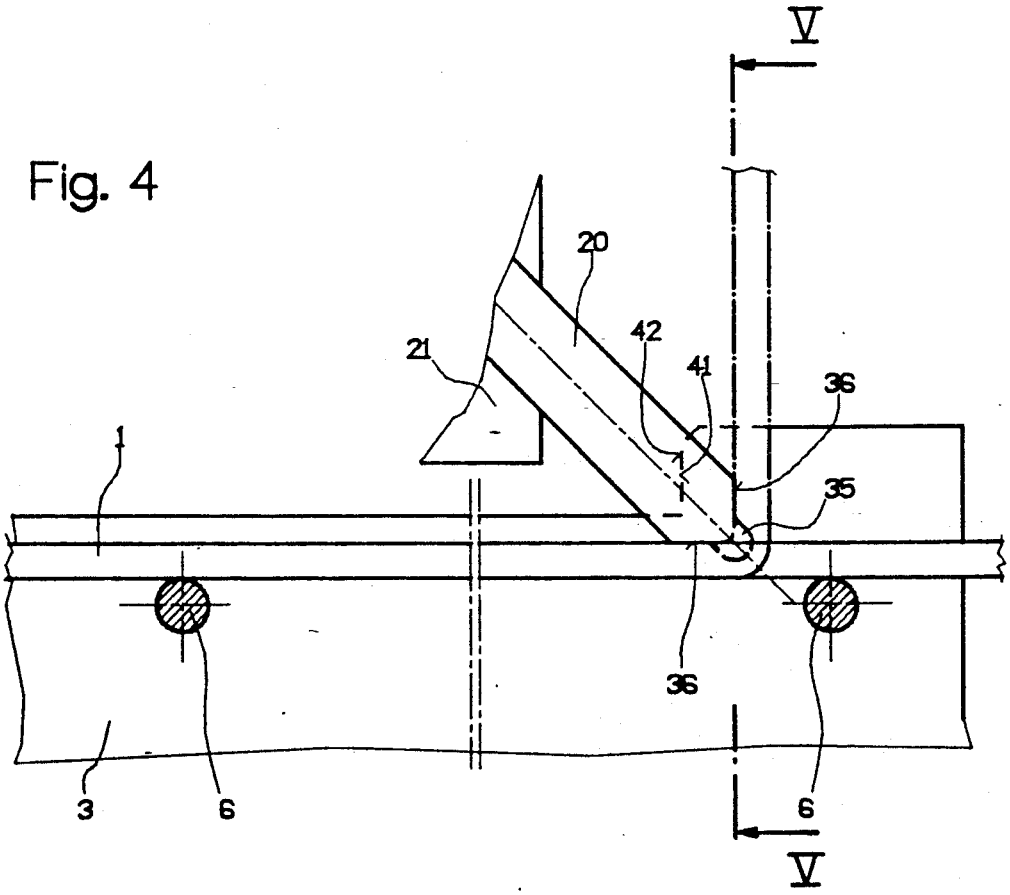
FIG. 4 shows a detail of the bending head in the zone of the bending abutment.

As illustrated in FIGS. 1 and 2 and, in particular, FIG. 4, the abutment 20 carries at its forward tip, formed by two inclined surfaces 36 producing an acute angle to the longitudinal direction of the bending abutment 20, a bead-like extension 35; the latter, as shown in FIG. 4, makes a certain inward arch in the upper surface of the hollow profile 1 clamped into the clamp 2 between the clamping jaws 3 and 4, still prior to the onset of the bending operation, namely during the pivoting of the bending abutment 20 into its operative position.

Figure 5:
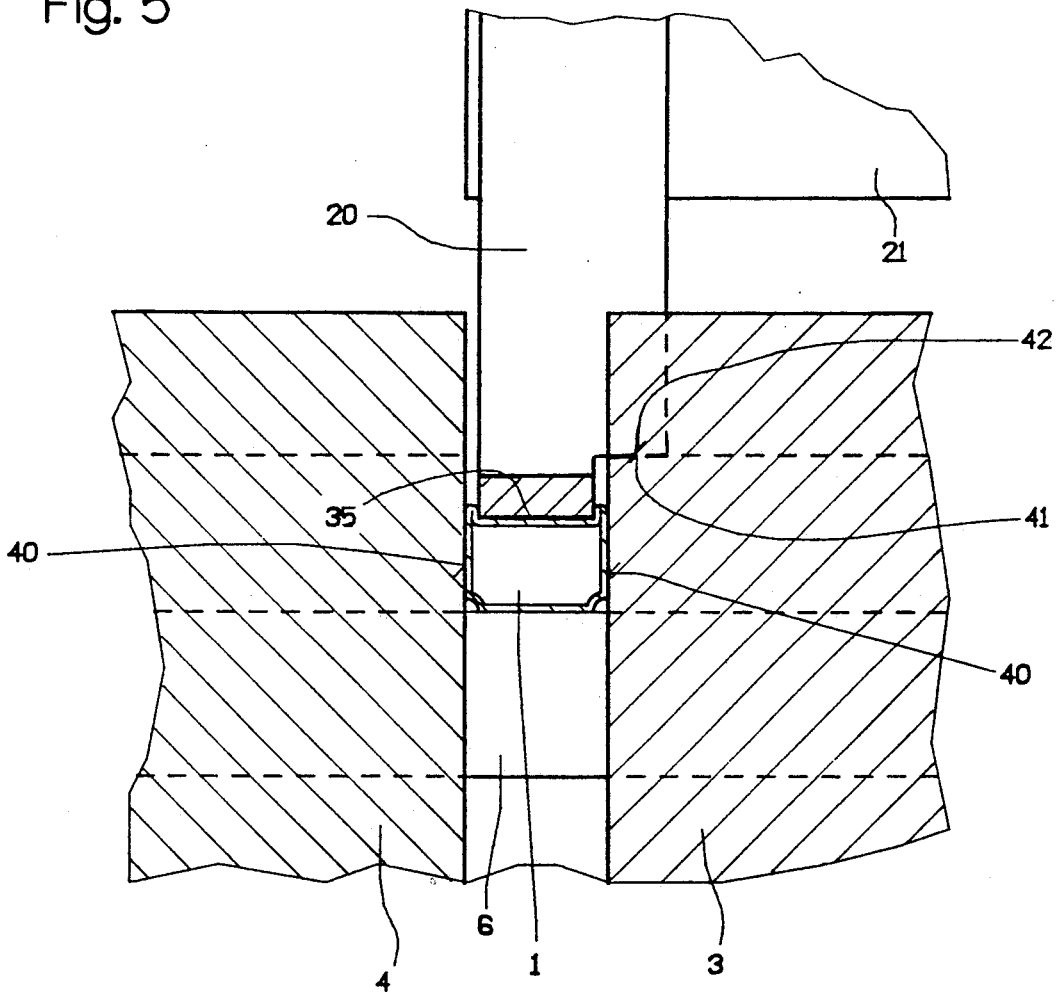
FIG. 5 is a section along line V—V in FIG. 4.
Figure 6:
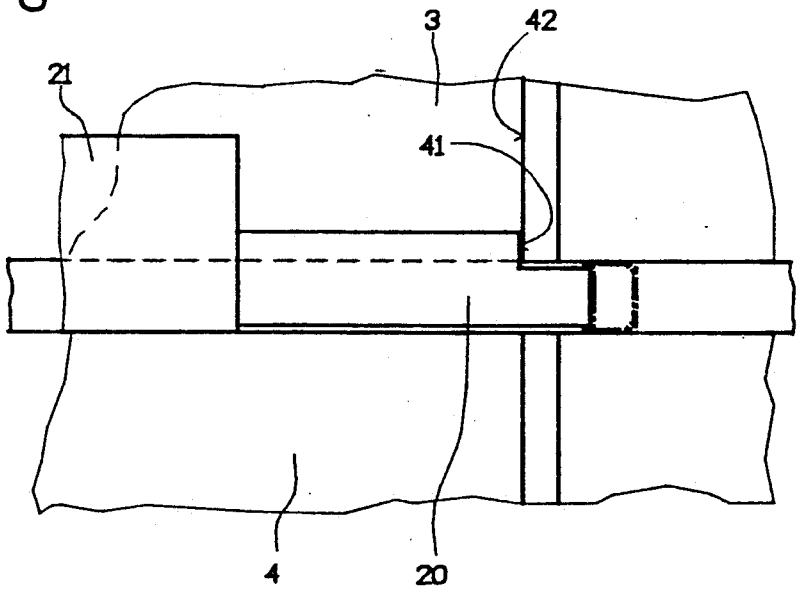
FIG. 6 shows an enlarged detail in the zone of the abutment.

In addition, the provision is made in the bending apparatus of this invention that the forward end of the abutment 20 and the bead-like extension 35 adjoining the oblique surfaces 36 at that location are fashioned to be somewhat narrower than the inside spacing between the mutually facing surfaces of the clamping jaws 3 and 4 of the clamp 2. Thus, the sidewalls 40 of the hollow profile strip 1 to be bent are also supported from the inside during the bending operation, as indicated in the sectional view of FIG. 5. This is of importance, in particular, when bending hollow profile strips 1 into spacer frames for insulating glass panes since the width of the lateral surfaces 40 of the hollow profile strip 1 is not to be reduced at all, if possible, even in the corner zone, and these lateral surfaces 40, in the corner zone, are not to deviate toward the inside from the planes defined by the lateral surfaces 40 so that it is possible to apply the adhesive and caulking material, to be provided prior to assembly of the insulating glass panes at the spacer frames on their lateral surfaces 40, over the full width also in the corner zone which is of considerable importance for the leakproofness of insulating glass panes.

In order to correctly align the abutment 20, especially its bead-like extension 35, with respect to the clamping jaw 2 and thus with respect to the axis 37 about which the hollow profile strip 1 is bent, an angled stop surface 41 is provided at the abutment 20 in the zone of its forward end on one side; this stop surface cooperates with a step 42 on the fixed clamping jaw 3. Once the stop surface 41 is in contact with the step 42 of the clamping jaw 3, the axis 37 of the bead-like extension 35, provided at the front end of the bending abutment 20, is correctly aligned.

The apparatus according to this invention for performing a bending operation further includes a bending lever 50 with a bending extension 52 pivotable about an axis congruent with the axis 37 of the bead 35 at the front end of the bending tool 20 when the abutment 20 is in its operative position (the surfaces 41 are in contact with the surfaces 42 of the clamping jaw). The pivoting range of the bending lever 50 is not restricted to the 90° illustrated in FIG. 1 but rather also exceeds this value so that after the pivoting step (arrow 28) and the lateral displacement (arrow 29) of the bending abutment 20, it is even possible to make a bend with acute angles between the two legs of the hollow profile strip 1 adjoining the corner 51 produced in the hollow profile strip 1.

For bending a hollow profile strip 1 into a corner, the clamp 2 is opened and the hollow profile strip 1 is placed on the upper guide pins 6 or is pushed by a conveying means onto the guide pins 6. After the clamp 2 has been closed, with the inner surfaces of the clamping jaws 3 and 4 in contact with the lateral surfaces 40 of the hollow profile strip 1, the abutment 20 is moved into its operative position shown in FIGS. 1 and 4, and during this step produces a certain downward arch in the upwardly pointing wall of the hollow profile strip 1. Thereupon, the portion of the hollow profile strip 1 projecting out of the clamp 2 is swung upwards by pivoting the bending lever 50 with the formation of a corner 51. If the angle at the corner 51 is to be an acute one, the abutment 20 is pivoted back and retracted laterally whereupon bending is continued to the desired angle.

Thereupon, the bending lever 50 is pivoted back, the clamping jaw is opened, and the hollow profile strip 1 is shifted until the location of the hollow profile strip 1 where a further corner is to be produced is correctly aligned with respect to the bending tool. Then, as described above, the next corner is produced by bending. This procedure is continued until a spacer frame having the desired number of corners 51—in most cases four—has been created by bending.

The bending apparatus of this invention is suitable with preference for bending machines having an upwardly pointing contact surface for the angled portions of the hollow profile strip 1 (for example, German Utility Model 8,705,796). In this connection, an additional advantage resides in that the abutment 20, in its ready position, does not impede the carrying away of the spacer frame since the abutment is arranged in this position behind the aforementioned contact surface.

Figure 7:
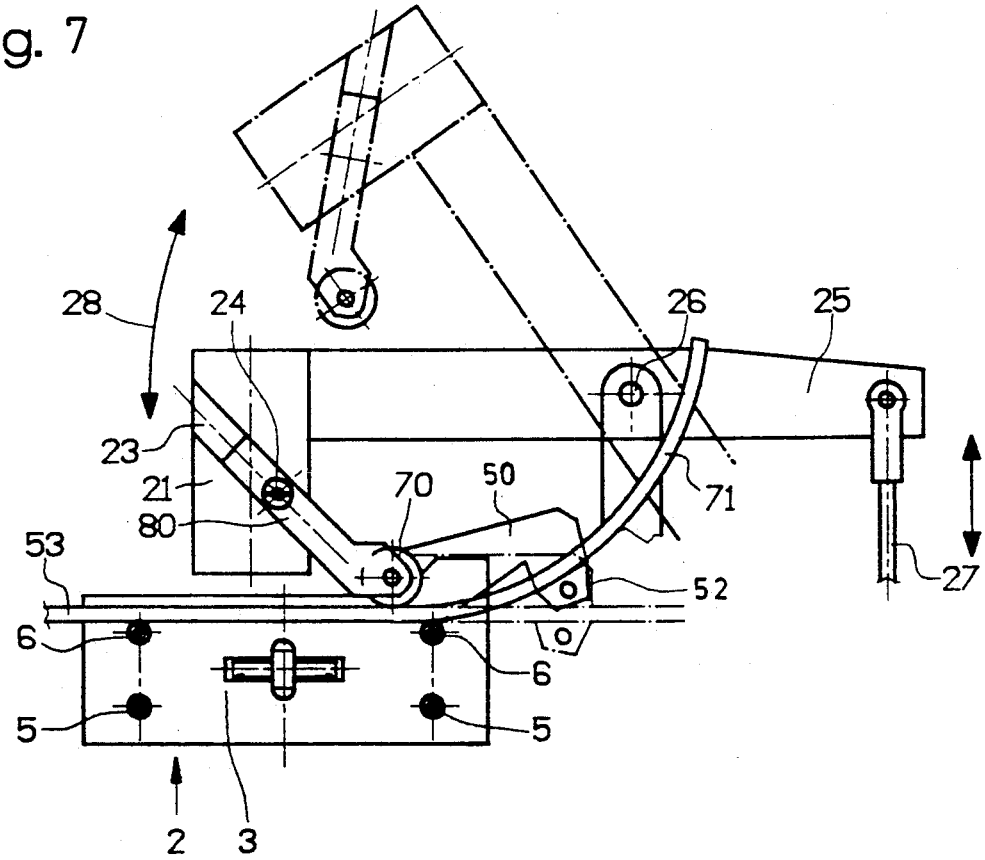
FIG. 7 shows an embodiment with a bending abutment equipped with a roller.

The invention also extends to an embodiment wherein a freely rotatable roller 70 is provided at the free end of the abutment 80 in place of the beadlike extension 35. The roller 70 has a width corresponding to the extension 35. This embodiment is illustrated in FIG. 7.

Both embodiments of the bending apparatus according to the invention can also be utilized for the production of arcs 71 in hollow profile strips 1. For this purpose, the hollow profile strip 1, with the abutment 20 or 80 swung into place, is advanced by a feeding device wherein the bending lever 50, as shown in FIG. 7, is swung somewhat in the upward direction. The radius of curvature of the thus-produced arc 71 in the hollow profile strip depends on the extent to which the bending lever 50 has been swung upwardly, i.e. on the height occupied by the bending extension 52, consisting, for example, of a synthetic resin of low coefficient of friction, above the feeding route (determined by the guide pins 6).

What is claimed is:

1. In apparatus for bending hollow profile strips (1), comprising a clamp (2) for the hollow profile strip (1), the clamp having two clamping jaws (3, 4) movable relative to each other for varying the distance between the jaws, said jaws being adapted to contact lateral surfaces (40) of the hollow profile strip (1) to be bent, a support (6) for the hollow profile strip (1) to be bent between the clamping jaws (3, 4), an abutment (20, 80) on the clamp (2), about which the bending step is performed, this abutment being in contact, during the bending step, with the surface of the hollow profile strip (1) which later on forms an inner corner, and a bending lever (50) pivotable with respect to the clamp (2) in order to perform the bending operation, this bending lever being adapted to contact a portion of the hollow profile strip (1) projecting past the clamp (2) the improvement wherein said abutment (20, 80) is mounted on a support (21) which latter is adjustable both parallel to the plane of symmetry of the clamp (2), and also perpendicularly to this plane of symmetry for moving the abutment (20, 80) out of the bending plane.

2. Apparatus according to claim 1, wherein the support (21) for the abutment (20, 80) is pivotable about an axis (bearing 26) perpendicular to the plane of symmetry of the clamp (2).

3. Apparatus according to claim 1, wherein the support (21) for the abutment (20, 80) is displaceably guided in a holder (31) perpendicularly to the plane of symmetry of the clamp (2).

4. Apparatus according to claim 1, wherein the support (21) for the abutment (20, 80) is mounted on a lever (25) which latter is supported on the apparatus pivotably about an axis perpendicular to the plane of symmetry of the clamp (2).

5. Apparatus according to claim 4, wherein the support (21) for the abutment (20, 80) is guided in a holder (31) attached to the lever (25) to be displaceable perpendicularly to the plane of symmetry of the clamp (2) on guide means (30).

6. Apparatus according to claim 4, wherein the pivot axis (bearing 26) of the lever (25) carrying the support (21) for the abutment (20, 80) is offset with respect to the pivot axis (37) of the bending lever (50).

7. Apparatus according to claim 1, wherein the abutment (20, 80) is mounted on its support (21) in an exchangeable fashion.

8. Apparatus according to claim 7, wherein the abutment (20, 80) is carried by the support (21) in a groove (23) provided on the support (21), with a sliding fit, and is fixable in position along said groove.

9. Apparatus according to claim 1, wherein one of the clamping jaws (3) of the clamp (2) is fixedly attached to a frame of the apparatus, and the second clamping jaw (4) is guided in a displaceable fashion with respect to the fixed clamping jaw (3).

10. Apparatus according to claim 1, wherein, for guiding the movable clamping jaw (4) with respect to the fixed clamping jaw (3), guide rods (5, 6) aligned perpendicularly to the plane of symmetry of the clamp (2) are provided which engage in bores in one of the clamping jaws (3, 4) with a sliding fit, said guide rods (6) simultaneously constituting a bearing for the hollow profile strip to be bent.

11. Apparatus according to claim 10, wherein the movable clamping jaw (4) is coupled with a linear motor to move the clamping jaw.

12. Apparatus according to claim 1, wherein one of the clamping jaws (3, 4) of the clamp (2) has a step (42) on its side facing the abutment (20, 80), and the abutment (20, 80) has a counter surface (41) engaging the step (42) when the abutment (20) is in the operative position.

13. Apparatus according to claim 1, wherein the abutment (20) has at a forward end thereof a bead-like thickened portion (35) which is narrower than the hollow profile strip (1) to be bent.

14. Apparatus according to claim 12, wherein the bending lever (50) is pivotable about an axis (37) perpendicular to the plane of symmetry of the clamp (2), this axis being coaxial to the axis of the bead (35) at the front end of the abutment (20) when the abutment (20) is in its operative position.

15. Apparatus according to claim 1, wherein a roller (70) is mounted on the free end of the abutment (80), this roller being freely rotatable about an axis parallel to the pivot axis (37) of the bending lever (50).

16. Apparatus according to claim 15, wherein the bending lever (50) is pivotable about an axis (37) perpendicular to the plane of symmetry of the clamp (2), this axis being coaxial to the axis of rotation of the roller (70) at the front end of the abutment (80) when the abutment (80) is in its operative position.

* * * * *